US006297482B1

(12) United States Patent
Becker

(10) Patent No.: US 6,297,482 B1
(45) Date of Patent: Oct. 2, 2001

(54) CERAMIC-BASED DOWNDRAFT COOKTOP HAVING ANGLED FRONT FACE PORTION

(75) Inventor: Theodore A. Becker, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/626,388

(22) Filed: Jul. 26, 2000

(51) Int. Cl.[7] ..... H05B 3/68; F24C 3/00

(52) U.S. Cl. ..... 219/445.1; 219/452.11; 126/393

(58) Field of Search ..... 219/445.1, 446.1, 219/451.1, 452.11, 452.12, 460.1; 126/39 H, 39 J, 39 K, 90 A, 92 A, 76, 211, 217, 299 R

(56) References Cited

U.S. PATENT DOCUMENTS

| | | | |
|---|---|---|---|
| D. 113,275 | | 2/1939 | Miller . |
| D. 271,269 | | 11/1983 | Vetter et al. . |
| 2,233,463 | | 3/1941 | Wilson . |
| 2,632,434 | | 3/1953 | Pearce . |
| 3,313,919 | | 4/1967 | Richardson et al. . |
| 3,409,005 | * | 11/1968 | Field ..... 126/299 R |
| 3,627,986 | | 12/1971 | Anderson . |
| 3,781,522 | | 12/1973 | Borom et al. . |
| 3,816,704 | | 6/1974 | Borom et al. . |
| 3,870,861 | | 3/1975 | Werych . |
| 3,886,539 | | 5/1975 | Gould, Jr. . |
| 3,936,660 | | 2/1976 | Blackwood . |
| 4,004,130 | | 1/1977 | Blackwood . |
| 4,149,217 | | 4/1979 | Tucker . |
| 4,169,222 | | 9/1979 | Tucker . |
| 4,501,260 | | 2/1985 | Grace . |
| 4,816,647 | | 3/1989 | Payne . |
| 4,899,028 | | 2/1990 | Arai et al. . |
| 5,155,338 | | 10/1992 | Hoffman . |
| 5,221,829 | | 6/1993 | Yahav et al. . |
| 5,279,279 | | 1/1994 | White . |
| 5,357,079 | | 10/1994 | Henry et al. . |
| 5,357,080 | | 10/1994 | Vetter et al. . |
| 5,374,807 | | 12/1994 | Yahav et al. . |
| 5,399,840 | | 3/1995 | Goeddekke . |
| 5,508,495 | | 4/1996 | Yahav et al. . |
| 5,549,100 | | 8/1996 | Heisner et al. . |
| 5,611,327 | | 3/1997 | Filho et al. . |
| 5,679,273 | | 10/1997 | Petetin . |
| 5,796,346 | | 8/1998 | Wash et al. . |
| 5,847,364 | | 12/1998 | White et al. . |
| 5,859,410 | | 1/1999 | White et al. . |
| 6,050,176 | | 4/2000 | Schultheis et al. . |
| 6,067,980 | | 5/2000 | Kahlke et al. . |
| 6,087,637 | | 7/2000 | Fischer et al. . |
| 6,103,338 | | 8/2000 | Gille et al. . |

* cited by examiner

*Primary Examiner*—Sang Paik
(74) *Attorney, Agent, or Firm*—Diederiks & Whitelaw, PLC

(57) ABSTRACT

A unitary, one-piece, bent ceramic-based cooktop, mounted on a countertop or upon an appliance cabinet, includes a main plate portion, which defines varies spaced heating element zones, and a face plate portion, which is integral with the main plate portion, and extends forward and downward from a frontal section of the main plate portion. The face plate portion defines a control panel having various knobs and/or switches for use in regulating the operation of heating elements of the cooktop, as well as a control device for a downdraft venting system that includes a grill provided in a generally, laterally centered portion of the main plate portion. In accordance with the most preferred form of the invention, electronic control components are utilized and openings are formed in the face plate portion to accommodate mounting of the electronic control components generally flush with the exposed surface of the face plate portion.

12 Claims, 1 Drawing Sheet

CERAMIC-BASED DOWNDRAFT COOKTOP HAVING ANGLED FRONT FACE PORTION

BACKGROUND OF THE INVENTION

1. Field of the Invention

The present invention pertains to the art of cooking and, more particularly, to a ceramic-based cooktop including a main plate portion extending in a substantially horizontal plane and a face plate portion which projects forward and downward from a frontal section of the main plate portion, with the face plate portion defining a control panel for regulating the activation state of various heating elements arranged on the main plate portion.

2. Discussion of the Prior Art

Both gas and electric cooking appliances are widely available in today's marketplace. The cooktops associated with electric cooking arrangements employ either coiled, electric resistance burner elements which project slightly above the upper surface of the associated cooktop, or smooth cooktops. Smooth cooktops are formed of glass or ceramic-based, i.e., ceramic and glass-ceramic, materials.

Due to material characteristic limitations, care must be taken when forming a ceramic-based cooktop as the material can be subject to cracking and the like when stressed. This potential problem is of particular concern given that the ceramic-based cooktop must be free to flex during use. For at least these reasons, a ceramic-based cooktop will almost invariably be made as a plate extending in a single plane and without any openings. However, it has been proposed, as disclosed in U.S. Pat. No. 5,357,079, to create a bend at a rear section of a cooktop. Although controls for various heating elements are arranged adjacent to the bent zone of the cooktop, the controls are actually supported by a frame upon which the cooktop is supported. The upper surface of a ceramic-based cooktop is generally provided with a grid pattern to diminish the inherent transparent nature of the material. In the '079 patented arrangement, small transparent regions are maintained to provide visual clarity of illuminated displays mounted below the cooktop.

In order to enhance the use and versatility of ceramic-based cooktops, it would be desirable to enable heating element control devices to be mounted to the cooktop. However, mounting of the control devices from the upper planar surface is not considered most desirable from a ergodynamic standpoint. Therefore, it is considered desirable to provide a ceramic-based cooktop with a front, angled portion at which are mounted readily available operator controls.

SUMMARY OF THE INVENTION

The present invention is directed to a unitary, ceramic-based cooktop, adapted to be mounted on a countertop or upon an appliance cabinet, having an angled front portion. More specifically, the cooktop is formed as a one-piece member including a main plate portion, which defines varies spaced heating element zones, and a face plate portion which is integral with the main plate portion and extends forward and downward from a frontal section of the main plate portion. Therefore, the main and face plate portion extend in respective, intersecting planes. The face plate portion defines a control panel having various knobs and/or switches for use in regulating the operation of heating elements of the cooktop. The cooktop also preferably incorporates a downdraft venting system including a grill provided in a generally, laterally centered portion of the main plate portion, with the face plate portion also including suitable controls for the downdraft venting system. In accordance with the most preferred form of the invention, electronic control components are utilized and openings are formed in the face plate portion to accommodate mounting of the electronic control components. Most preferably, the electronic control components are generally flush with an exposed surface of the face plate portion to avoid the components being any type of obstruction during use of the cooktop.

Additional objects, features and advantages of the invention will become more fully apparent below from the following description of a preferred embodiment of the invention when taken in conjunction with the drawings wherein like reference numerals refer to corresponding parts in the several views.

DETAILED DESCRIPTION OF THE PREFERRED EMBODIMENT

Figure 1:
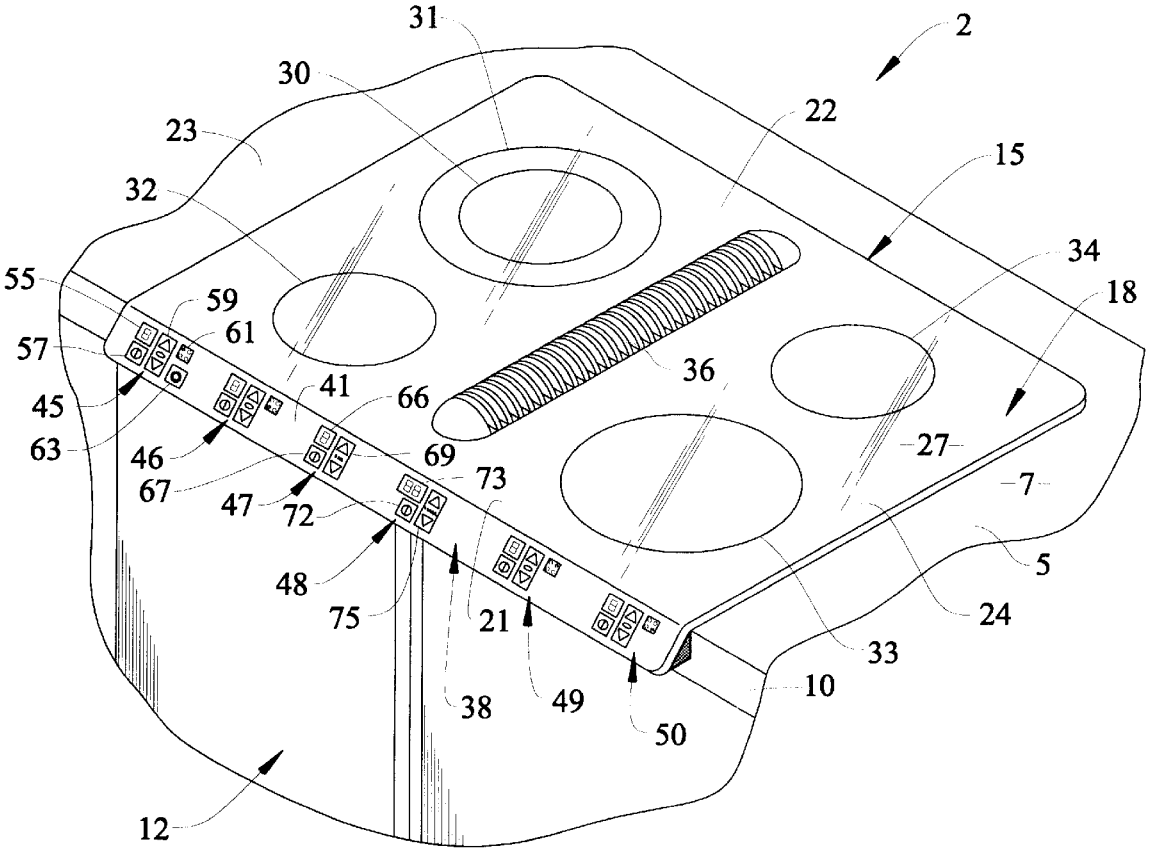
FIG. 1 is a perspective view of a ceramic-based cooktop having an angled front face portion constructed in accordance with the invention mounted upon a countertop.
Figure 2:
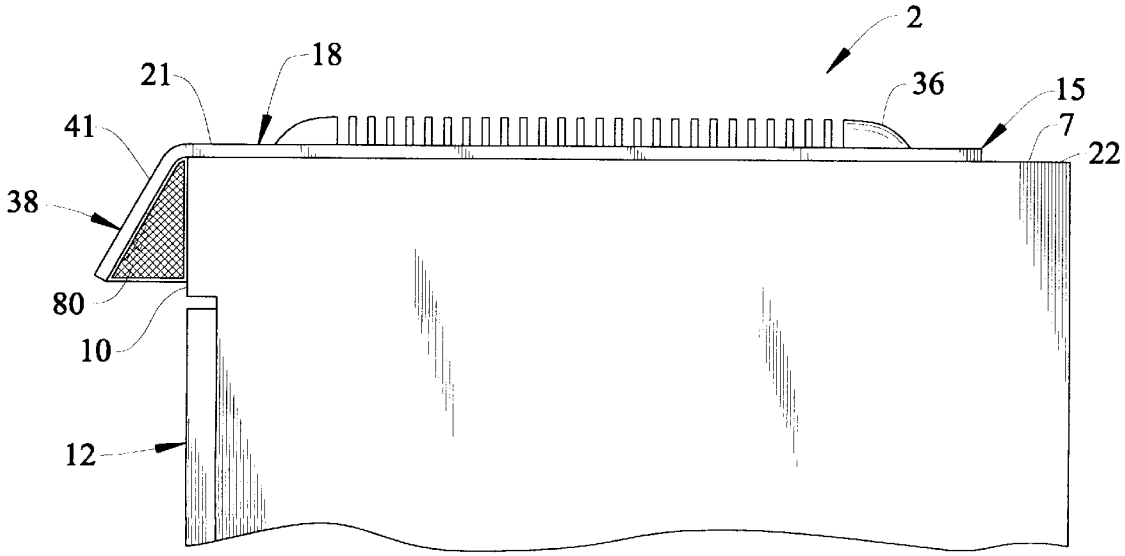
FIG. 2 is a side elevational view of the cooktop of FIG. 1.

With reference to both FIGS. 1 and 2, a kitchen cooking arrangement, generally indicated at 2, includes a countertop 5 having an upper surface 7 which extends in a generally horizontal plane and a front edge portion 10 which is depicted to be generally perpendicular to upper surface 7. Below countertop 5 is illustrated to be cabinetry 12. At this point, it should be noted that countertop 5 could be positioned against a wall within a kitchen or can form part of an island. Kitchen cooking arrangement 2 also incorporates a cooktop 15 that includes a main plate portion 18 which is secured upon upper surface 7 of countertop 5. Main plate portion 18 is generally defined by a frontal section 21, a rear section 22 and side edge sections 23 and 24. Main plate portion 18 has an upper surface 27 which defines various spaced heating element zones 30–34, with heating element zone 30 being concentrically arranged within heating element zone 31.

As shown, in the most preferred embodiment, upper surface 27 constitutes a smooth top-type cooking surface. More specifically, cooktop 15 is made from a ceramic-based material. By referring to cooktop 15 as being made from a ceramic-based material, it is intended to cover various materials including ceramic, glass-ceramic and like materials. Although cooktop 15 preferably includes a smooth cooking surface, heating element zones 30–34 could be defined by coiled resistance-type heating elements or even gas burners extending above upper surface 27. However, a smooth cooking surface is provided in accordance with the preferred invention. Also provided in accordance with the most preferred form of the invention is a downdraft venting arrangement including a grill 36 which, as shown, extends fore-to-aft from frontal section 21 to rear section 22 in a central portion of upper surface 27.

Cooktop 15 also includes a face plate portion 38 that defines a heating element control panel. Face plate portion 38 includes an exposed surface 41 and is formed integral with main plate portion 18 such that the overall cooktop 15 defines a unitary, one-piece and integrally formed member. As clearly shown in these figures, face plate portion 38 extends downwardly and forwardly from main plate portion 18. In a preferred embodiment, cooktop 15 is positioned upon countertop 5 with face plate portion 38 projecting beyond front edge portion 10. In the most preferred form of the invention, face plate portion 38 is angled downwardly from main plate portion 18 in a range of about 45°–60°. That is, main plate portion 18 extends in a first plane which is substantially horizontal and face plate portion 38 extends in a second plane which intersects the first plane of main plate portion 18. In the most preferred form of the invention, these planes intersect at a 60° angle. In other words, exposed surface 41 of face plate portion 38 is preferably located at an obtuse angle in the range of 225°–240°, most preferably 240°, from upper surface 27 of main plate portion 18.

With face plate portion 38 extending at an angle to the horizontal and projecting forward of front edge portion 10 of countertop 5, face plate portion 38 can be advantageously utilized as a control panel for the heating elements in zones 30–34. In the most preferred form of the invention, face plate portion 38 is formed with various openings (not separately labeled) which receive electronic control element arrays generally indicated at 45–50. Electronic control element array 45 includes an illumination display 55 which preferably constitutes a single, eight-segment LED, a main on/off button 57, a heating element regulating switch 59, a heating element zone indicator 61 and a secondary on/off button 63.

In accordance with the embodiment shown, main on/off button 57 directly controls the activation of heating element zone 30. More specifically, depressing on/off button 57 a single time will activate the heating element associated with zone 30 and pressing on/off button a second time will de-activate the heating element associated with zone 30. Zone indicator 61 preferably provides a reference to the user that electronic control element array 45 pertains to heating element zones 30 and 31. That is, zone indicator 61 takes the form of a box representative of main plate portion 18, with the box including spaced individual circles representing the various heating element zones 30–34. In the most preferred embodiment, zone indicator 61 has simply darkened in the upper leftmost circular area to bring the user's attention to the fact that electronic control element array 45 controls zones 30 and 31. It is also possible in accordance with the present invention to illuminate the particular zone represented area in zone indicator 61, such as with a red diode, to indicate when a heating element zone 30, 31 is activated. Such a diode can be connected to a temperature sensor to remain lit even after the heating element zone 30, 31 is deactivated, with the light being extinguished when the temperature extends below a level at which it is safe to touch that portion of upper surface 27 of cooktop 15. Button 63 controls the activation of the heating element associated with zone 31 in a manner analogous to the operation of button 57. At this point, it should be understood that zone 31 can be activated through button 63 either only following the placement of button 57 in an on condition or button 63 can actually be used to simultaneously activate zones 30 and 31. In any event, it is desired to only permit activation of zone 31 concurrently with zone 30.

Electronic control element arrays 46, 49 and 50 are essentially identically constructed to that of electronic control element array 45, except that control element arrays 46, 49 and 50 lack a corresponding control button 63 and a different portion of zone indicator 61 is highlighted. Since these various control element arrays 46, 49 and 50 are structured and function in a corresponding manner, the description thereof will not be duplicated here. Electronic control element array 47 includes a corresponding display 66 which provides a visual indication for the exhaust speed level for the downdraft system associated with grill 36. Therefore, display 66 indicates the fan speed level; power to the downdraft system is controlled by on/off button 67; and the level of operation of downdraft system is controlled by regulating switch 69.

Electronic control element array 48 is provided to establish a timer control in connection with cooktop 15. Therefore, control element array 48 includes a timer on/off button 72, a multi-digit display 73 and a timer regulator switch 75 which can be used to toggle up and down the display. Although not shown, this overall timer arrangement would be linked to an audible signalling device. In fact, all of the electronic control element arrays 45–50 are linked to a main controller (not shown) used for regulating the operation of cooktop 15. Since the use of such a controller is considered well within one of ordinary skill in the art, details thereof are not provided here.

Based on the above, it should be readily apparent that the cooktop 15 of the present invention provides for an enhanced control panel arrangement for a user while maintaining the integrity of the overall cooktop. That is, face plate portion 38 supports the control components necessary to operate cooktop 15 in more conveniently located positions versus the more conventional arrangement wherein separate knobs would be provided upon countertop 5 adjacent cooktop 15. Of course, it should be realized that, although electronic control element arrays 45–50 are utilized in accordance with the preferred embodiment, other types of control elements, including rotary knobs or the like, could also be employed. The extension of face plate portion 38 beyond front edge portion 10 of countertop 5 enables cooktop 15 to be readily utilized in connection with countertops positioned against a wall and also kitchen island arrangements, while providing an advantageous clearance for the routing of wires or the like. In the preferred form of the invention, one or more covers, such as wire cover 80, is provided for containment and aesthetic purposes. Of course, the style and materials used in connection with cover 80 can vary in accordance with the invention. In the most preferred form, cover 80 actually extends across cooktop 15 behind face plate portion 38 to further block access to the electronic control components and associated wiring. Given the positioning of the face plate portion 38, electronic control array elements 45–50 are generally isolated from the main flexing of main plate portion 18 during operation of cooktop 15 and it has been found that this construction enables face plate portion 38 to be formed with multiple apertures which will not result in fatigue failure. Due to the unitary construction, cleaning of both surfaces 27 and 41 can be readily performed. In any event, although the invention has been described with respect to a preferred embodiment, it should be recognized that various changes and/or modifications can be made without departing from the spirit of the invention. Instead, the invention is only intended to be limited by the scope of the following claims.

I claim:

1. A kitchen cooking arrangement comprising:

a substantially planar countertop including an upper surface and a front edge portion which extends below a plane of the upper surface; and a unitary, ceramic-based cook-top supported upon the countertop, said cooktop including: a main plate portion having a frontal section, a rear section and side edge sections, within which are defined a plurality of spaced heating element zones of said cooktop, said main plate portion extending in a first plane; and a face plate portion, integral with the main plate portion, extending forward and downward from the frontal section of the main plate portion such that the face plate portion extends in a second plane that intersects the first plane, said face plate portion defining a heating element control panel for said cooktop, wherein said main and face plate portions have respective upper surfaces, said face plate portion being bent relative to the main plate portion such that an angle in the range of 225°–240° is defined between the upper surface of the face plate portion and the upper surface of the main plate portion.

2. The kitchen cooking arrangement according to claim 1, wherein the cooktop has a substantially uniform thickness from the rear section of the main plate portion to the face plate portion.

3. The kitchen cooking arrangement according to claim 1, further comprising: a downdraft grill positioned atop the main body portion and outside the spaced heating element zones.

4. The kitchen cooking arrangement according to claim 1, wherein the face plate portion extends over and beyond the front edge portion of the countertop.

5. A kitchen cooking arrangement comprising:

a substantially planar countertop including an upper surface and a front edge portion which extends below a plane of the upper surface;

a unitary, ceramic-based cooktop supported upon the countertop, said cooktop including: a main plate portion having a frontal section, a rear section and side edge sections, within which are defined a plurality of spaced heating element zones of said cooktop, said main plate portion extending in a first plane; and a face plate portion, integral with the main plate portion, extending forward and downward from the frontal section of the main plate portion such that the face plate portion extends in a second plane that intersects the first plane, said face plate portion defining a heating element control panel for said cooktop, said main and face plate portions having respective upper surfaces, said face plate portion being bent relative to the main plate portion such that an angle in the range of 225°–240° is defined between the upper surface of the face plate portion and the upper surface of the main plate portion, wherein the face plate portion extends over and beyond the front edge portion of the countertop; and at least one cover extending between the face plate portion of the cooktop and the front edge portion of the countertop.

6. The kitchen cooking arrangement according to claim 5, wherein said main and face plate portions have respective upper surfaces, said face plate portion being bent relative to the main plate portion such that an angle is defined between the upper surface of the face plate portion and the upper surface of the main plate portion.

7. The kitchen cooking arrangement according to claim 6, wherein the angle is in the range of 225°–240°.

8. A unitary, ceramic-based cooktop comprising:

a main plate portion having a frontal section, a rear section and side edge sections, within which are defined a plurality of spaced heating element zones of said cooktop, said main plate portion extending in a first plane; and a face plate portion, integral with the main plate portion, extending forward and downward from the frontal section of the main plate portion such that the face plate portion extends in a second plane that intersects the first plane, said face plate portion defining a heating element control panel for said cooktop, wherein said main and face plate portions have respective upper surfaces, said face plate portion being bent relative to the main plate portion such that an angle in the range of 225°–240° is defined between the upper surface of the face plate portion and the upper surface of the main plate portion.

9. The ceramic-based cooktop according to claim 8, wherein the cooktop has a substantially uniform thickness from the rear section of the main plate portion to the face plate portion.

10. The ceramic-based cooktop according to claim 8, further comprising: a downdraft grill positioned atop the main body portion and outside the spaced heating element zones.

11. The ceramic-based cooktop according to claim 8, further comprising: a plurality of electronic control elements mounted along the face plate portion.

12. The ceramic-based cooktop according to claim 11, wherein the electronic control elements include a digital display for each of the spaced heating element zones.

* * * * *